US005083344A

United States Patent [19]

Pettit et al.

[11] Patent Number: 5,083,344

[45] Date of Patent: Jan. 28, 1992

[54] PIVOTAL SUPPORT BRACKET FOR A WINDOW HINGE

[75] Inventors: Dean A. Pettit; Mary B. Rhodes, both of Owatonna, Minn.

[73] Assignee: Truth Division of SPX Corporation, Owatonna, Minn.

[21] Appl. No.: 582,092

[22] Filed: Aug. 27, 1990

[51] Int. Cl.[5] ..... E05D 7/10; E05D 15/44; E05C 17/32

[52] U.S. Cl. ..... 16/254; 16/363; 16/371; 49/252; 292/263

[58] Field of Search ..... 16/254, 257, 271, 341, 16/360, 363, 368, 369, 370, 371, 361, 364, 366, 223, 225, 227, 261; 49/252, 250, 251; 248/201; 292/263

[56] References Cited

U.S. PATENT DOCUMENTS

| | | | |
|---|---|---|---|
| 2,654,127 | 10/1953 | Graves, Jr. | 49/252 |
| 2,990,570 | 7/1961 | Gilpatrick | 16/257 |
| 3,432,882 | 3/1969 | Farouche | 16/257 |
| 3,497,907 | 3/1970 | Colina | 16/257 |
| 4,040,267 | 8/1991 | Dallman | 49/252 |
| 4,364,201 | 12/1982 | Taylor | 16/341 |
| 4,414,706 | 11/1983 | Douglas | 16/370 |
| 4,622,715 | 11/1986 | Buckley | 16/370 |
| 4,689,852 | 9/1987 | Buckley | 16/341 |
| 4,718,144 | 1/1988 | Buckley | 49/252 |
| 4,726,092 | 2/1988 | Tacheny et al. | 16/370 |
| 4,833,754 | 5/1989 | Yang | 49/252 |
| 4,980,947 | 1/1991 | McQuigge | 16/254 |

FOREIGN PATENT DOCUMENTS

| | | | |
|---|---|---|---|
| 2204355 | 11/1988 | United Kingdom | 292/263 |

*Primary Examiner*—Lowell A. Larson
*Assistant Examiner*—Thomas C. Schoeffler
*Attorney, Agent, or Firm*—Wood, Phillips, Mason, Recktenwald & Van Santen

[57] ABSTRACT

A window hinge having a track mountable to a window frame, a sash arm mountable to a window sash, and a plurality of pivotally interconnected links connecting the track to the sash arm to allow pivotal movement of the sash relative to the window frame. At least one of the links is pivotally connected to a shoe movable on the track and another of the links is pivotally connected to a block. The block includes a projecting stud and is elastically deformable to allow sliding of the block in the track with the stud retracted until snappingly securing the stud in a mounting slot in the track during field assembly. The hinge is mounted by first fixing the track to a window frame and the sash arm to a window sash, thereafter sliding the shoe and the block in the track to dispose the block stud adjacent the track slot, then fixing the block to the track with the block stud in the track slot.

18 Claims, 2 Drawing Sheets

PIVOTAL SUPPORT BRACKET FOR A WINDOW HINGE

FIELD OF THE INVENTION

The present invention relates to support brackets, and more particularly to brackets supporting pivotal movement of windows.

BACKGROUND OF THE INVENTION

Hinges for supporting casement-type windows or transom-type windows are well known in the art. Commonly, these hinges include a track mountable to a window frame and a sash arm mountable to a window sash. Pivoted links and associated structure (such as a shoe slidable in the track) mount the sash arm to the track to support the window sash when pivoted between open and closed positions (see, for example, Taylor U.S. Pat. No. 4,364,201). In the closed position, the sash arm and links are disposed opposite the track with the inside of the sash arm aligned with the inside edge of the track to assure tight closing of the window. Windows usually include two such hinges operating together on opposite sides of the window.

Typically, the sash arm and track are secured together by the links and associated structure during manufacture of the hinge by use of one or more rivets. For example, Buckley U.S. Pat. No. 4,622,715 discloses a hinge which pivots one of its links about a rivet secured to the track. As another example, Buckley U.S. Pat. Nos. 4,689,852 and 4,718,144 disclose hinges which secure a block to the track by one or more rivets.

Such hinges necessitate first mounting the sash arms to the sash (or the tracks to the window frame) and then, while supporting the often heavy and large sash, mounting the tracks to the window frame (or the sash arm to the sash). Such mounting can be very difficult or clumsy, and thus is not only time consuming and expensive (often requiring two installers) but can also result in the mismounting of the second mounted component (i.e., either the tracks or the sash arms). Such mismounting can prevent the window from providing a good seal against weather, and can further cause the window to operate poorly when opened or closed.

Further, it is often advantageous to clean the hinge periodically after installation to ensure that the sliding and hinging components operate smoothly. However, once installed, the hinge links and other components can get in the way so as to hinder proper cleaning (particularly of the track and sliding shoe).

Still further, in the event that some component of the hinge is so damaged as to require replacement, replacement of the entire hinge is required. Further, in that event (or in the event that cleaning is accomplished by removal of the hinge), replacement not only results in the same difficulties as original installation as described above, but further can result in a degraded structure with the track and/or sash arm remounted by screws located in stripped holes in the wood of the frame and/or sash.

Yang U.S. Pat. No. 4,833,754 discloses one hinge which attempts to avoid the above problems. However, this hinge requires inclusion of pivots which will not provide as secure a hinge as rivets conventionally used heretofore, thereby possibly degrading the reliability of the operation of the hinge over the long life usually expected of hinges.

The present invention is directed toward overcoming one or more of the problems as set forth above.

SUMMARY OF THE INVENTION

In one aspect of the present invention, a window hinge is provided having a track mountable to a window frame, a sash arm mountable to a window sash, and a plurality of pivotally interconnected links connecting the track to the sash arm to allow pivotal movement of the sash relative to the window frame. At least one of the links is pivotally connected to a shoe movable on the track and another of the links is pivotally connected to a block. The block includes a projecting stud and is elastically deformable to allow sliding of the block in the track with the stud retracted until snappingly securing the stud in a mounting slot in the track during field assembly.

In another aspect of the present invention, the above described hinge is mounted by first fixing the track to a window frame and the sash arm to a window sash, thereafter sliding the shoe and the block in the track to dispose the block stud adjacent the track slot, then fixing the block to the track with the block stud in the track slot.

It is an object of the present invention to provide a secure and reliably operating hinge which can be used to quickly, easily, inexpensively, and reliably mount a window sash to a window frame.

It is another object of the present invention to provide a hinge which will securely mount the window to provide a reliable seal against weather.

A further object of the present invention is to provide a window hinge which can be easily maintained to operate smoothly over a long useful life.

Still another object of the present invention is to provide a hinge which may be easily and inexpensively removed during maintenance (or partially replaced when damaged) and still retain a strong mounting of the replaced hinge component to the frame and/or sash.

DETAILED DESCRIPTION OF THE PREFERRED EMBODIMENT

Figure 1:
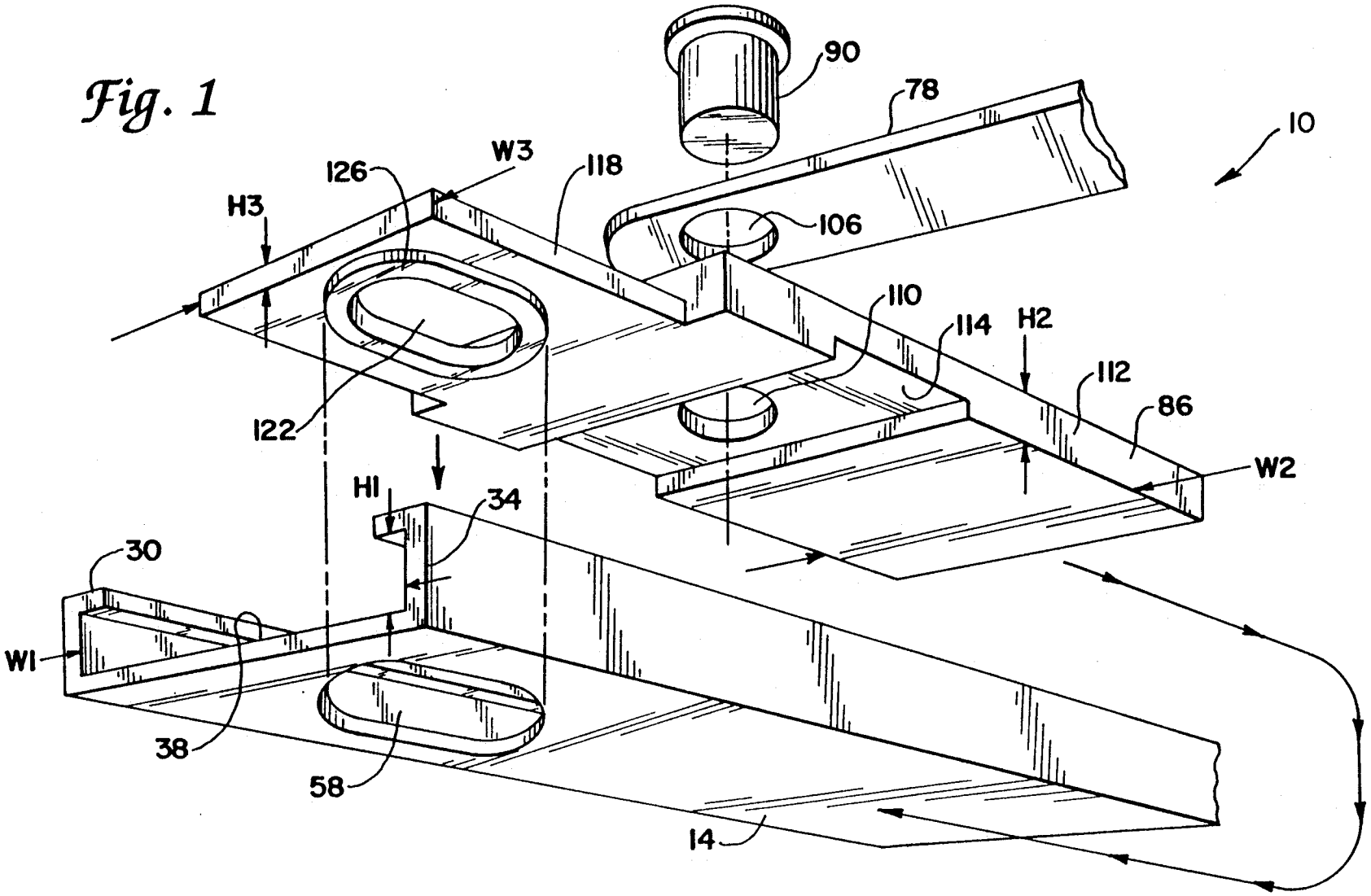
FIG. 1 is a perspective view of a window hinge embodying the present invention.

A window hinge (or supporting bracket) 10 embodying the present invention is shown generally in FIG. 1. The window hinge 10 includes an elongated track 14 adapted to be secured to a window frame (not shown) and has upwardly turned flanges 30,34 and a planar portion 38.

The flanges 30,34 are spaced apart a width W1, have approximately equal height H1 (see FIG. 2), and turn inwardly at their upper ends define a channel. A suitable shoe or sliding member 42 is shaped to slide within the channel both during assembly and operation of the hinge 10 as will become apparent. Such shoes 42 are common in hinges of the type described herein and are well known in the art.

A sash arm 46 is adapted for securing to the underside of a window sash (not shown) by suitable fasteners, such as wood screws (not shown), through openings 50,54 in the sash arm 46.

The track 14 also includes openings or mounting slots 58,62 facilitating mounting thereof to the window frame by use of fasteners (not shown) therethrough. Again, any suitable fastener, such as a wood screw, can be used within the scope of the invention as will become apparent hereafter.

The sash arm 46 is mounted for movement relative to the track 14 by a plurality of pivoted links.

In the hinge shown in FIG. 1, a first link 66 is pivotably connected to the shoe 42 by rivet 70. The other end of the first link 66 is pivotally connected to the sash member 46 adjacent an end thereof by rivet 74.

A second link 78 is pivotally connected at one end by rivet 82 to the sash arm 46 intermediate the ends thereof. At the other end, the second link 78 is pivotally connected to a block 86 by rivet 90, which defines a fixed pivot relative to the track 14 (as will be described in greater detail hereafter).

One end of a third link 94 is pivotally connected by rivet 98 to the shoe 42. Rivet 102 pivotally connects the other end of the third link 94 to an intermediate point on the second link 78.

As is known in the art, the sash arm 46 also preferably includes a tapered end 104 which cooperates with a cap 105 (see FIG. 1) to help maintain the components in alignment when the hinge 10 is closed.

As will be understood by those having ordinary skill in this art, the hinge 10 will pivot a sash open from a window frame by pivoting of the links 66, 78, 94 and by sliding of the shoe 42 in the track 14. It should be understood, however, that the link arrangement shown is merely exemplary, and the present invention could also be used with hinges having a wide variety of other link arrangements connecting a window frame track and a window sash arm.

Figure 2:
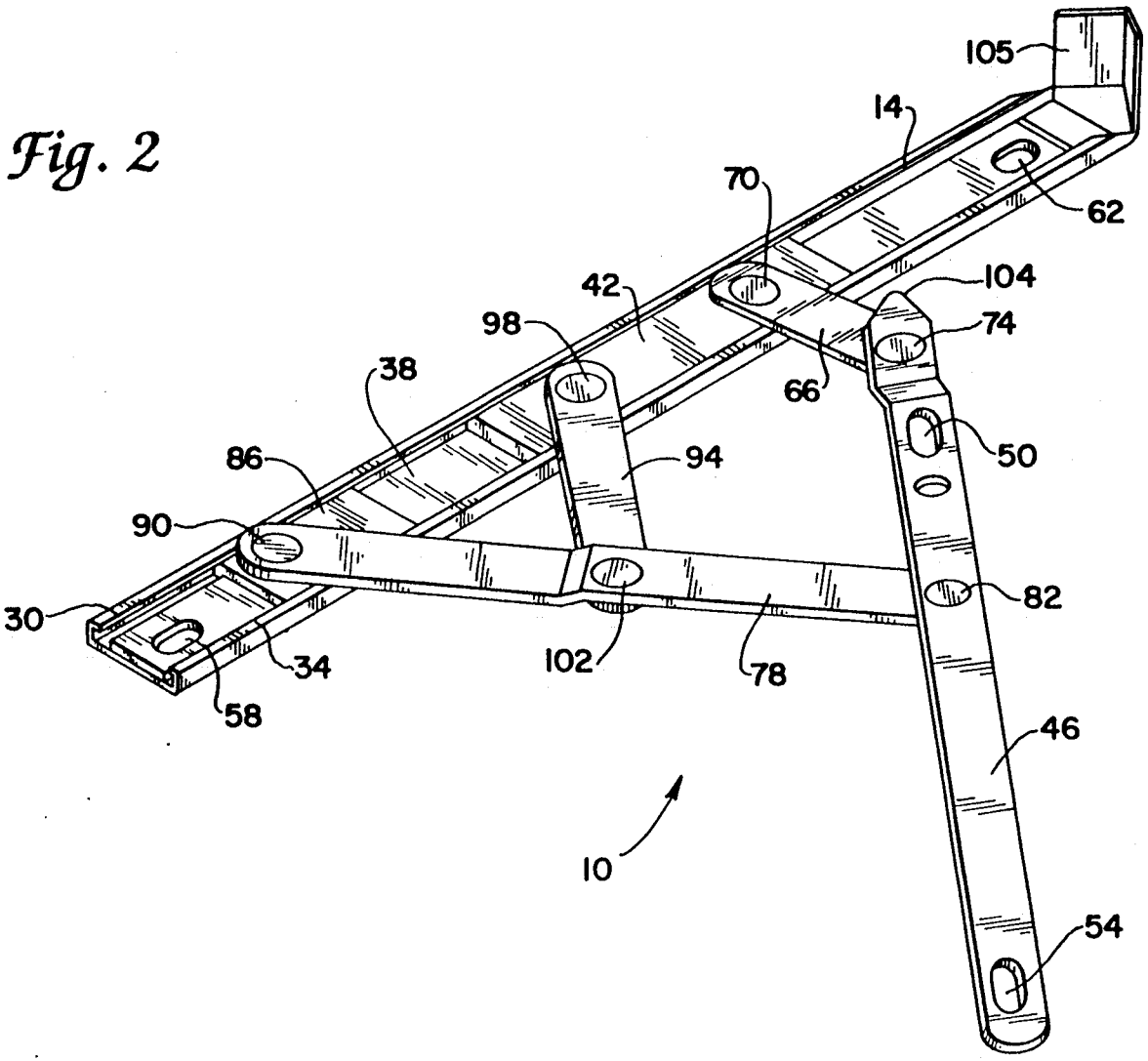
FIG. 2 is an exploded view of the block, track, and one link connected according to the invention.

The manner in which the fixed pivot defined by rivet 90 is located is shown in detail in FIG. 2. Specifically, the second link 78 has a hole 106 therethrough aligned with a hole 110 through a first block portion 112. The rivet 90 extends through the two holes 106, 110 and may be suitably deformed during the manufacturing of the hinge 10 to allow smooth pivoting about the axis of the rivet 90. On its underside, the block 86 includes a recess or cutout portion 114 for accommodating the head of the rivet 90 formed during the manufacturing process (of course, alternatively, the formed rivet head could be located on the other end adjacent the link 78).

As will be understood by those having ordinary skill in this art, this pivotal rivet connection can be formed in any suitable manner within the scope of the present invention. For example, though both of the holes 106, 110 and the entire rivet shaft are illustrated as cylindrical, it is only important that one hole and the portion of the rivet shaft therein be so shaped. Further, one component hole (106 or 110) typically is formed with a reduced diameter and receives a reduced diameter portion of the rivet. With such a configuration, a shoulder on the rivet engages the other component (either the block or link) to prevent the link and block from being undesirably squeezed together (and therefore binding against one another) as a result of the formation of the second rivet head.

The first block portion 112 has a width W2 which is equal to, or preferably slightly less than, the width W1 of the track 14. Further, along the sides adjacent the upper ends of the flanges 30, 34, the block 86 has a height H2 equal to, or preferably slightly less than, the height H1 of the flanges 30, 34. Accordingly, the block 86 can be slidably inserted into the track 14 during assembly as hereinafter described.

A second block portion 118 includes an oblong hole 122, and a raised area or boss 126 about the periphery of the hole 122 projects from the side of the second block portion 118 adjacent the track planar portion 38. The boss 126 is receivable in the mounting slot 58 of the track 14 when assembled as is also hereinafter described.

The second block portion 118 has at least a width W3 or a height H3 less than either the width W1 or height H1 of the track 14, respectively. Further, the second block portion 118 has at least a width W3 or height H3 less than the width W2 or height H2 of the first block portion 112, respectively. This ensures that the second block 118 portion may be bent during assembly without binding in the track 14 as hereinafter described more fully.

The block 86 is preferably formed of a suitable hard plastic which will provide a secure pivotal connection at the rivet 90 while also allowing for elastic bending of the second block portion 118 during assembly as hereinafter described.

Specifically, the hinge 10 of the present invention is manufactured by pivotally connecting, preferably by rivets, the sash arm 46, the pivot links 66, 78, 94, the shoe 42, and the block 86 as shown. The sash arm 46 may then be conveniently and easily mounted to a window sash. (It should be understood, of course, that window installations typically require two such hinges on opposite sides of the window, and thus the operations described here would be done for both hinges).

The hinge track 14, without the shoe 42 or block 86 therein, may also be conveniently and easily preliminarily mounted to the window frame by a suitable fastener (such as a wood screw) through the hole 62 in one end of the track 14.

The installer may then, either in the field or in a window manufacturing plant, very easily and quickly lift the window sash and manipulate the sash in order to slide the shoe 42 into the track 14, so that the weight of the sash is thereafter supported by the hinge 10. Final installation of the sash and hinge 10 is thus easily accomplished without the installer being thereafter burdened with supporting the weight of the sash.

Specifically, final installation includes sliding the block 86 into the track 14. Initial sliding (of the first block portion 112) is readily accomplished until the boss 126 of the second block portion 118 reaches the track 14. The installer then merely bends the second block portion 118 (either by hand or by using a screwdriver or other suitable tool) to clear the boss 126 from the track planar portion 38, and then manipulates the sash to further slide the block 86 therein.

When the boss 126 passes over the track mounting slot 58, the second block portion 118 snaps back into its undistorted condition with the boss 126 in the slot 58 to essentially fix the block 86 relative to the track 14. At that point, the track 14 can be precisely positioned to provide proper orientation and sealing of the window sash relative to the frame, as the track 14 can be pivoted about the fastener in mounting slot 62 and can further be moved longitudinally past the fastener as a result of the oblong shape of the mounting slot 62. Once so positioned, the track 14 can be securely fixed to the window frame by tightening the mounting fastener in mounting slot 62 and also securing a similar fastener through block hole 122 and track mounting slot 58.

As will be understood by a skilled artisan having an understanding of the above described invention, hinges embodying this invention can quickly, easily, inexpensively, and reliably mount a window sash to a window frame by minimizing the time during which the heavy window sash must be supported by the installer. Further, this is accomplished without degrading the reliability of the hinge to operate smoothly and properly over a long expected life.

Hinges embodying the present invention can further be easily maintained over the life of the window inasmuch as removal for cleaning (and/or replacement when damaged) can similarly be easily accomplished without requiring that the sash be supported for long periods of time during replacement.

Still further, inasmuch as the track 14 is separable from the remainder of the hinge 10, should the pivot links or pivotal connections become damaged so as to require replacement, this can be accomplished without requiring replacement of the track as well.

Still other aspects, objects, and advantages of the present invention can be obtained from a study of the specification, the drawings, and the appended claims.

We claim:

1. A window hinge having a track mountable to a window frame, a sash arm mountable to a window sash, and improved means for linking said track to said sash arm to allow pivotal movement of the sash relative to the window frame between open and closed positions, comprising:

a plurality of pivotally interconnected links, at least one of said links being pivotally connected to said sash arm, at least one of said links being pivotally connected to a shoe movable on said track, and a last one of said links being pivotally connected at a fixed pivot relative to said track;

a mounting slot in said track; and a block defining the fixed track pivot and having a projecting stud, said block being elastically deformable to allow sliding of said block in said track with said stud retracted until snappingly securing said stud in said mounting slot when slid to said slot during assembly.

2. A window hinge as recited in claim 1 wherein said block also has a first hole therethrough corresponding with said mounting slot of said track such that means for securing said block and track to said frame can be inserted therethrough.

3. A window hinge as recited in claim 1, further comprising a rivet pivotally securing said last link to said block and defining said fixed pivot.

4. A window hinge as recited in claim 1, wherein said block includes a first and second portion, said first portion being shaped for sliding in said track during assembly and said second portion including said stud and being bendable relative to said first portion to clear said stud from said track during assembly.

5. A window hinge as recited in claim 4, wherein said second block portion is narrower than said first block portion and said track.

6. A window hinge as recited in claim 4, wherein said second block portion is shallower than said first block portion and said track.

7. A window hinge as recited in claim 6, wherein said second block portion is narrower than said first block portion and said track.

8. A method of mounting the hinge recited in claim 1, comprising:

fixing the track to a window frame and the sash arm to a window sash;

positioning said block and said shoe for guided movement along the track with said block being disposed in an elastically deformed condition;

thereafter sliding said shoe and said block in said track to dispose said block stud adjacent said track slot and snappingly secure said block stud in said track slot; and fixing said block to said track with the block stud in the track slot.

9. A supporting bracket comprising:

a track member having a planar portion with a mounting slot therethrough and a pair of folded side flanges along at least a substantial length of said planar portion to form a channel, said track member adapted to be fixed to a window frame;

a window sash member adapted to be fixed to a window sash;

a shoe slidably disposed in said channel;

a first link pivotally connected to said shoe and to said window sash member;

a block defining a fixed track pivot and having a projecting stud adjacent said track member planar portion, said block being elastically deformable to allow sliding of said block in said track without interference by said stud until said stud is disposed adjacent said slot during assembly;

a second link pivotally connected to said window sash member and said block; and a third link pivotally connected to said slide member and said second link.

10. The bracket as recited in claim 9 wherein said block has a width less than the width of said channel such that said block is slidable in said channel during field assembly.

11. The bracket as recited in claim 9 wherein said block includes a hole through said stud for mounting with said track member.

12. The bracket as recited in claim 9, wherein said block includes a first and second portion, said first portion being shaped for sliding in said track member during assembly and said second portion including said stud and being bendable relative to said first portion to clear said stud from said track member planar portion during assembly.

13. The bracket as recited in claim 12, wherein said second block portion is narrower than said first block portion and said track.

14. The bracket as recited in claim 12, wherein said second block portion is shallower than said first block portion and said track.

15. The bracket as recited in claim 14, wherein said second block portion is narrower than said first block portion and said track.

16. A method of mounting the hinge recited in claim 9, comprising:

fixing the track member to a window frame and the sash member to a window sash;

positioning said block and said shoe for guided movement along said track member with said block being disposed in an elastically deformed condition;

thereafter sliding said shoe and said block in said track member to dispose said block stud adjacent said track member slot and snappingly secure said block stud in said track member slot; and fixing said block to said track member with the block stud in the track member slot.

17. A window hinge comprising:

a track member having two ends, a planar portion, a mounting slot near one end of said planar portion, and a pair of folded side flanges along at least a substantial length of said planar portion to form a channel, said track member being adapted to be fixed to a window frame;

a sash arm adapted to be fixed to a window sash;

a slide member movably disposed in said channel;

a first link pivotally connected to said slide member and to said window sash member;

a block having a first side adjacent said track member planar portion and a boss projecting from said first side, said block being distortable during field assembly to clear the boss from the track member planar portion and allow sliding of said block along said track member until said boss projects into said mounting slot when disposed adjacent thereto during field assembly;

a second link pivotally connected to said window sash member and said block; and a third link pivotally connected to said slide member and said second link.

18. A window hinge as recited in claim 17, further comprising a rivet pivotally securing said second link to said block.

* * * * *